United States Patent [19]

Blasingame

[11] 4,012,042

[45] Mar. 15, 1977

[54] INVERTIBLE POCKETED TARGET FOR A DISC THROWING GAME

[76] Inventor: Steve J. Blasingame, 1111 12th Ave., Yuma, Ariz. 85364

[22] Filed: Jan. 19, 1976

[21] Appl. No.: 650,060

[52] U.S. Cl. ..... 273/95 R; 273/105 R

[51] Int. Cl.[2] ..... A63B 67/06

[58] Field of Search ..... 273/95 R, 102 R, 105 R, 273/113, 4 R, 127 R, 181 R, 181 A

[56] References Cited

UNITED STATES PATENTS

| | | | |
|---|---|---|---|
| 677,938 | 7/1901 | Carson | 273/4 A |
| 742,927 | 11/1903 | Stults | 273/105 R |
| 2,287,113 | 6/1942 | Markey | 273/105 R |
| 3,306,615 | 2/1967 | Tack | 273/95 R |
| 3,464,699 | 9/1969 | Dollar | 273/113 |
| 3,887,181 | 6/1975 | Samaras | 273/105 R |

*Primary Examiner*—Richard C. Pinkham
*Assistant Examiner*—Vance Y. Hum
*Attorney, Agent, or Firm*—Herbert E. Haynes, Jr.

[57] ABSTRACT

A game utilizing at least one target tray structure having a pocket therein at which disc shaped projectiles are thrown. The tray is invertible to provide either a single pocket of a predetermined scoring value or to provide an array of pockets having various scoring values.

5 Claims, 6 Drawing Figures

INVERTIBLE POCKETED TARGET FOR A DISC THROWING GAME

BACKGROUND OF THE INVENTION

1. Field of the Invention

This invention relates to games and more particularly to a game involving the throwing of projectiles at a target tray structure with that structure being invertible to allow the playing of various games thereon.

2. Description of the Prior Art

A number of projectile throwing games have been devised, and in general the playing of those games is restricted to areas that cannot be damaged by misdirected projectiles, and the equipment employed is such that only one type of game can be played with that equipment. Further, due to such factors as the weight of the projectiles, the distances that the projectiles must be thrown, and the like, the aged and/or infirm are prevented from participating therein.

For example, the game of horseshoes cannot practically be played indoors and the equipment employed in that game is adapted only for the playing of that well known game. The weight of the horseshoes and the distance between the pegs (usually 40 feet) is such that playing by the aged and/or infirm is limited.

Therefore, a need exists for a new and improved projectile throwing game which employs equipment that can be handled by almost anyone in various locations, with that equipment being versatile for the playing of various games therewith.

SUMMARY OF THE INVENTION

In accordance with the present invention, a new and improved projectile throwing game is disclosed which employs at least one dismantleable target tray structure and a plurality of projectiles.

The target tray structure is provided with a planar floor which serves as a common bottom for a pair of trays that are disposed in a back to back relationship. The floor has a plurality of apertures formed therein with pocket means associated with each of the apertures. In a first position of the target tray structure, the pocket means are adapted to close all but one of the apertures so that a single aperture of predetermined scoring value is presented as a target for the projectiles. In the inverted, or second position, of the target tray structure, the pocket means are disposed so that all the apertures formed in the planar floor are opened to display an array of apertures of various scoring values.

It is preferred that the target tray structure be dismantleable for portability and ease of storage, and it is also preferred that the tray structure be provided with suitable padding means for minimizing the bounce and noise associated with projectiles impinging upon the target tray structure.

Accordingly, it is an object of the present invention to provide a new and improved throwing game and apparatus therefor.

Another object of this invention is to provide a new and improved throwing game and apparatus therefor which includes at least one target tray structure and a plurality of projectiles.

Another object of this invention is to provide a new and improved throwing game and apparatus therefor which includes at least one target tray structure and a plurality of projectiles, with that target tray structure having an upright or first position which displays a single projectile receiving pocket of predetermined scoring value, and having an inverted or second position which displays an array of projectile receiving pockets of various scoring values.

Still another object of this invention is to provide a new and improved throwing game and apparatus therefor which includes at least one target tray structure which is dismantleable for portability and ease of storage.

Yet another object of this invention is to provide a new and improved throwing game and apparatus therefor which includes at least one target tray structure having padding or mat means thereon to minimize the noise and bounce of projectiles impinging thereon.

The foregoing and other objects of this invention, the various features thereof as well as the invention itself, may be more fully understood from the following description when read in conjunction with the accompanying drawings.

DESCRIPTION OF THE PREFERRED EMBODIMENT

Figure 1:
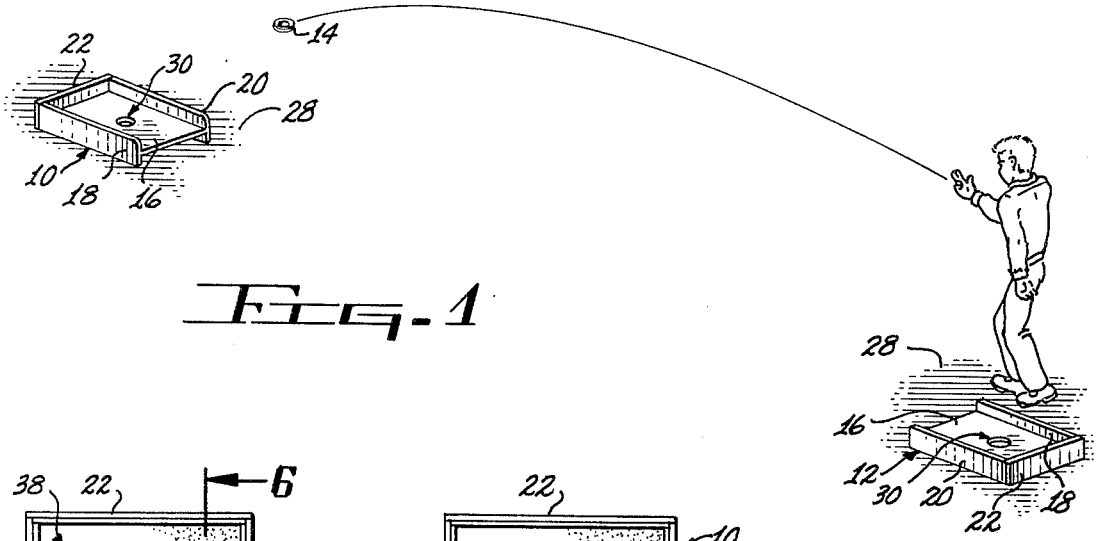
FIG. 1 is a perspective view illustrating the throwing game and apparatus of the present invention.
Figure 2:
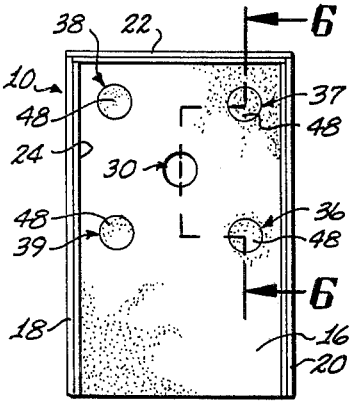
FIG. 2 is an enlarged plan view of the target tray structure of the present invention shown in the upright position thereof.

Referring more particularly to the drawings, FIG. 1 illustrates the preferred form of the game of the present invention as including a pair of identical target structures which are indicated generally by the reference numerals 10 and 12. As shown in FIG. 1, the target structures 10 and 12 are spaced apart a suitable distance so that a plurality of projectiles 14 (one shown in FIG. 1) may be thrown from the proximity of the target structure 12 toward the target structure 10. When all of the projectiles 14 have been thrown toward the target structure 10 and the scoring has been compiled, as will hereinafter be described, the throwing of the projectiles will result in the opposite direction from the target structure 10 toward the target structure 12. This throwing from one target structure to the other will continue until one of the players has compiled a predetermined score.

It should be noted that the game of the present invention can be played with a single target structure, and in such an instance throwing of the projectiles will be accomplished in a single direction only from a prescribed throwing area toward the single target structure, and when all of the projectiles have been thus thrown, they are simply retrieved and re-thrown in the same manner.

Since the target structures 10 and 12 are identical, it will be understood that the following detailed description of the target structure 10 also applies to the target structure 12.

As best seen in FIGS. 2, 3, 5, and 6, the target structure 10 comprises a planar floor 16 of substantially rectangular configuration having its opposite side edges supportingly connected to a pair of spaced apart side walls 18 and 20, and having one of its end edges supportingly connected to a rear wall 22. As will hereinafter be described in detail, the floor 16 is demountably connected to the side and rear walls 18, 20, and 22 intermediate the longitudinal edges of those walls so that the floor serves as a common bottom for a pair of open front oppositely facing tray-shaped openings 24 and 26.

When the target structure 10 is placed upon a suitable supporting surface 28, such as the ground, one or the other of the oppositely facing tray-shaped openings 24 and 26 of the target structure 10 will be facing upwardly while the other is facing downwardly, and simply inverting the target structure 10 would reverse this orientation. For descriptive purposes, the orientation of the target structure 10 will herein be referred so as the upright or first position in which the tray-shaped opening 24 is facing upwardly, and the second or inverted position in which the tray-shaped opening 26 is facing upwardly.

The floor 16 of the target structure 10 is provided with a centrally located projectile receiving well 30 which includes an aperture 31 formed through the floor 16 and a pocket 32 which is adapted to receive one or more of the projectiles 14 which may enter into the well 30. The pocket 32 is fabricated of a suitable flexible material such as netting and is cup shaped to form an open neck 33 and a closed bottom 34. The open neck 33 of the pocket 32 is attached to the floor 16, such as with a suitable adhesive, so as to be substantially coaxial with the aperture 31, and the pocket 32 is reversible due to the flexible nature of the material of which it is fabricated. Thus, the central well 30 will always be open and the pocket 32 will form a projectile receiving container below the floor 16 regardless of whether the target structure 10 is in the upright or in the inverted position thereof.

The floor 16 is also provided with a plurality of satellite wells 36, 37, 38, and 39, with these satellite wells disposed in a suitable array about the central well 30. Each of the satellite wells 36, 37, 38, and 39 are identical, thus, the following description of the well 36 will be understood to also apply to the wells 37, 38, and 39.

Figure 5:
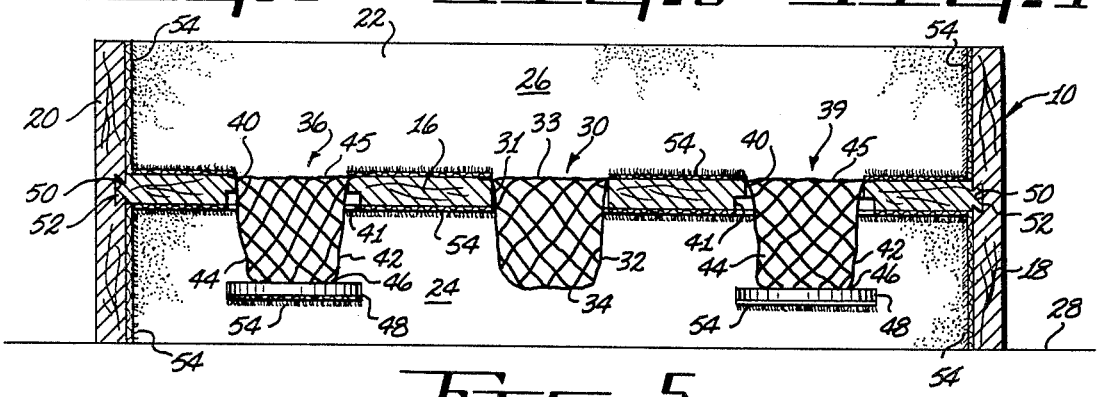
FIG. 5 is an enlarged sectional view taken along the line 5—5 of FIG. 3.
Figure 6:
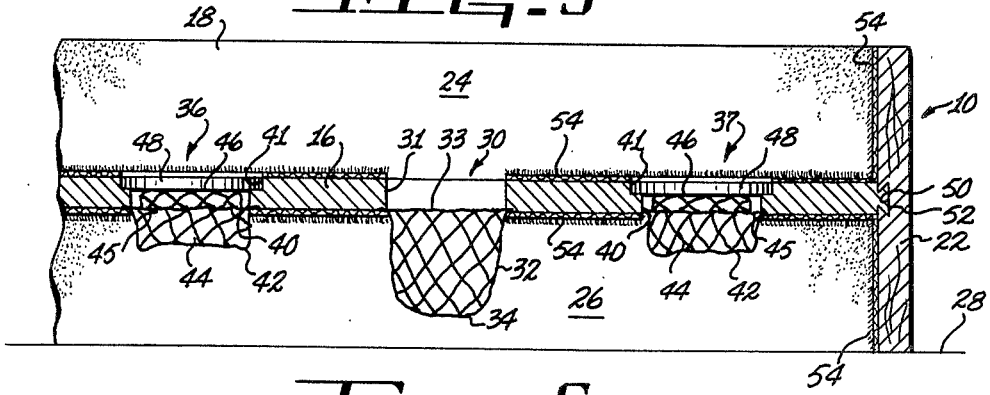
FIG. 6 is an enlarged fragmentary sectional view taken along the line 6—6 of FIG. 2.

The satellite well 36 includes an aperture 40 having a counterbore 41 and a pocket means 42 affixed to the floor 16 so as to be substantially coaxial with the aperture 40 and the counterbore 41. The pocket means 42 is adapted to form a projectile receiving container below the floor 16 in the inverted position of the target structure 10 as shown in FIG. 5, and to close the satellite well 36 in the upright position of the target structure 10 as shown in FIG. 6. The pocket means 42 includes a pocket 44 which is similar to the previously described pocket 32 in that it is fabricated of a flexible material such as netting, and is configured in a cup shape with an open neck 45 and a closed bottom 46. The pocket means 42 also includes a plug 48 which is affixed, such as with a suitable adhesive, to the closed bottom 46 of the pocket 44. The plug 48 is configured to be positionable within the counterbore 41 and to be substantially flush with the floor 16 in the first position of the target structure 10.

Figure 4:
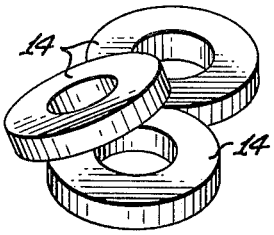
FIG. 4 is a perspective view illustrating a plurality of projectiles suitable for use in the apparatus of the present invention.

FIG. 4 illustrates the preferred form of the projectiles 14 as being washer shaped structures which are ideally sized approximately 2/3 of the size of the apertures 31 and 40, respectively, of the central well 30 and the satellite wells 36, 37, 38, and 39. Such a configuration of the projectiles 14 is preferred due to the minimum rolling thereof as compared to a ball (not shown). However, it should be understood that other types of projectiles, such as bean bags, (not shown) could be employed in the game and apparatus of the present invention. The number of projectiles 14 employed is suggested to be either two or three per player.

With the target structure 10 in its upright position with the tray-shaped opening 24 facing upwardly, the central well 30 will be open and the satellite wells 36, 37, 38, and 39 will be closed. With such an orientation of the target structure 10, a game similar to horseshoes can be played. For example, when a thrown projectile 14 lands in the central well 30, a score of 5 is credited to the thrower. When a projectile 14 lands on the floor 16 and a portion thereof extends over the well 30, a score of three is credited. If neither of these conditions occur, the projectile nearest the central well 30 will earn one point for its thrower. In this type of play, a cumulative score of 21, for example, can be used to determine a winner, or a game of "21 or Bust" can be played. As is well known, in a game of "21 or Bust" a player must accumulate exactly 21 points in order to win. If his score exceeds 21, he must start over.

Figure 3:
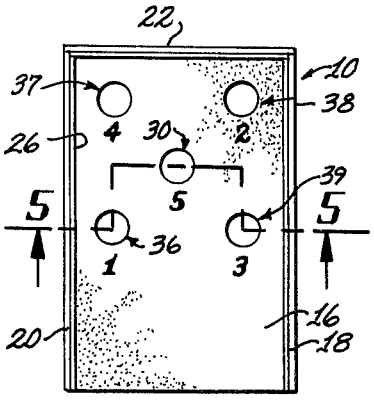
FIG. 3 is a view similar to FIG. 2 and illustrating the inverted position of the target tray structure of the present invention.

With the target structure 10 in its inverted position with the tray-shaped opening 26 facing upwardly, the central well 30 and the satellite wells 36, 37, 38, and 39 will all be open. Various types of games can be played with this orientation of the target structure 10. For example, the central well 30 is assigned a scoring value of 5, with each of the satellite wells 36, 37, 38, and 39, being assigned lesser values such as shown in FIG. 3 by the numerical indicia printed or otherwise applied adjacent the wells. It is suggested that in order to achieve any of the assigned scoring values, a player must throw his projectile into one of the wells and will receive the appropriate score provided that his opponent does not duplicate his effort by topping his projectile. Again, cumulative scoring can be employed to determine a winner, or a "21 or Bust" type of play can be used.

As hereinbefore mentioned, the target structure 10 is preferably fabricated as a disassemblable structure for ease of portability and storage. For this purpose, each of the side walls 18 and 20 and the rear wall 22 of the target structure 10 are provided with a longitudinal groove 50 extending therealong intermediate the longitudinal edges, and the corresponding side edges and rear edge of the floor 16 are each provided with a mating interlocking tongue 52. Assembly and disassembly of the target structure 10 may be accomplished by sliding the side and rear walls 18, 20, and 22 longitudinally along the tongues 52 of the floor 16.

It should be noted that as an alternative to the above described inversion of the target tray structure 10 for the purpose of playing the various games thereon, the same result can be achieved by disassembly of the target structure 10 and the reassembly thereof with the desired orientation of the floor 16.

It is further preferred that all of the interior surfaces of the target structure 10 have a suitable mat means 54 affixed thereto to minimize bounding of the projectiles 14 and the noise associated therewith. The mat means 54 may be any suitable material having a cushioning effect such as carpeting, sponge rubber, and the like. As seen best in FIGS. 5 and 6, the mat means 54 is affixed, such as with a suitable adhesive, to the inwardly disposed surfaces of the side walls 18 and 20 and to the inwardly facing surfaces of the rear wall 22. Also, the mat means 54 is affixed to both planar surfaces of the floor 16 and to the one surface of the plugs 48 which face away from the closed bottoms 46 of the pockets 42.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A game apparatus comprising:

a. at least one target structure having a first and a second tray-shaped openings facing oppositely with respect to each other;

b. a floor in said target which forms a common bottom for the first and the second tray-shaped openings thereof;

c. said target having an upright position in which the first tray-shaped opening thereof is facing upwardly and an inverted position in which the second tray-shaped opening thereof is facing upwardly;

d. said floor having a central projectile receiving all formed therein and having a plurality of satellite projectile receiving wells formed therein in an array about said central well, said central well and said satellite wells each having a scoring value;

e. each of said satellite wells including a pocket means, said pocket means affixed to said floor for closing said satellite wells in the upright position of said target and for forming projectile receiving containers in the inverted position of said target; and f. a plurality of projectiles for throwing at said central well when said target is in its upright position and for throwing at said central well and said satellite wells when said target is in the inverted position thereof.

2. A game apparatus as claimed in claim 1 wherein each of said satellite wells and said included pocket means further comprise:

a. said floor having an aperture formed therethrough with that aperture having a counterbore;

b. a pocket of flexible material, said pocket having an open neck which is affixed to said floor so as to position said pocket substantially coaxially with respect to the aperture and the counterbore formed in said floor, said pocket having a closed bottom; and c. a plug affixed to the closed bottom of said pocket, said plug positionable within the counterbore formed in said floor in the upright position of said target.

3. A game apparatus as claimed in claim 1 wherein said central well comprises:

a. said floor having an aperture formed substantially centrally therethrough; and b. a pocket of flexible material, said pocket having an open neck which is affixed to said floor so as to position said pocket substantially coaxially with respect to the aperture formed through said floor, said pocket being reversible to selectively provide a projectile receiving container on either side of said floor.

4. A game apparatus as claimed in claim 1 wherein said target structure further comprises:

a. a pair of elongated side walls each demountably connected intermediate its opposite longitudinal edges to a different one of the opposite side edges of said floor; and b. an elongated rear wall demountably connected intermediate its opposite longitudinal edges to one of the end edges of said floor.

5. A game apparatus as claimed in claim 1 wherein said target structure further comprises mate means affixed to the inwardly facing surfaces of the first and the second tray shaped openings formed in said target structure for cushioning the landing of said projectiles therein.

* * * * *